United States Patent [19]

Hoy, Jr.

[11] 4,384,857

[45] May 24, 1983

[54] SUBMERSIBLE FLOATATION STRUCTURE

[75] Inventor: Charles F. Hoy, Jr., Satellite Beach, Fla.

[73] Assignee: Starmax, Inc., Satellite Beach, Fla.

[21] Appl. No.: 183,758

[22] Filed: Sep. 3, 1980

[51] Int. Cl.[3] ..... B63C 9/30

[52] U.S. Cl. ..... 441/130; 114/331

[58] Field of Search ..... 297/31, 452, 377, DIG. 1, 297/DIG. 6; 9/11, 311, 347, 348; 114/315, 331; 272/1 B; 441/88, 129, 130, 131, 132

[56] References Cited

U.S. PATENT DOCUMENTS

| | | | |
|---|---|---|---|
| 1,555,589 | 9/1925 | Farina | 9/11 R |
| 2,717,400 | 9/1955 | Bourdon | 9/347 |
| 2,803,839 | 8/1957 | Mosley | 9/347 |
| 3,084,358 | 4/1963 | McLean | 9/337 |
| 3,211,495 | 10/1965 | Nielson | 297/377 |
| 3,425,231 | 2/1969 | Rehrer | 114/315 |
| 3,620,570 | 11/1971 | Wilson | 9/347 |
| 3,740,095 | 6/1973 | Nail | 441/130 |
| 3,751,030 | 8/1973 | Winters | 114/315 |
| 4,115,888 | 9/1978 | Sievers | 9/347 |

FOREIGN PATENT DOCUMENTS

| | | | |
|---|---|---|---|
| 21907 | of 1901 | United Kingdom | 9/347 |

*Primary Examiner*—Charles E. Frankfort
*Assistant Examiner*—Thomas J. Brahan
*Attorney, Agent, or Firm*—Kenyon & Kenyon

[57] ABSTRACT

A submersible floatation structure is formed of lengths of tubing which are interconnected by fittings. In one embodiment, the tubing end fittings are formed of a polymeric material, such as polyvinyl chloride. The tubing lengths and fittings are interconnected to form a selectable configuration, which, in some embodiments, may be in the form of a reclining chair, a raft, a buoy, or a life preserver ring. Valves are provided for allowing water to enter the structure and thereby provide a ballast which serves selectably to submerge the structure, or render the structure for use on land.

21 Claims, 9 Drawing Figures

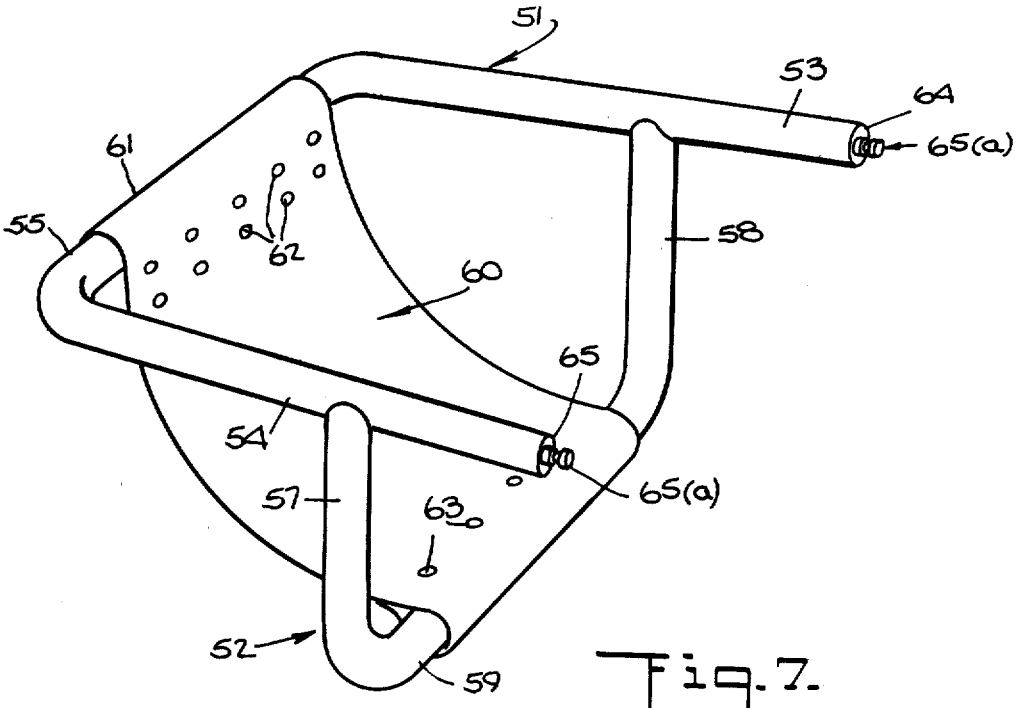
Fig. 7.
Fig. 8.
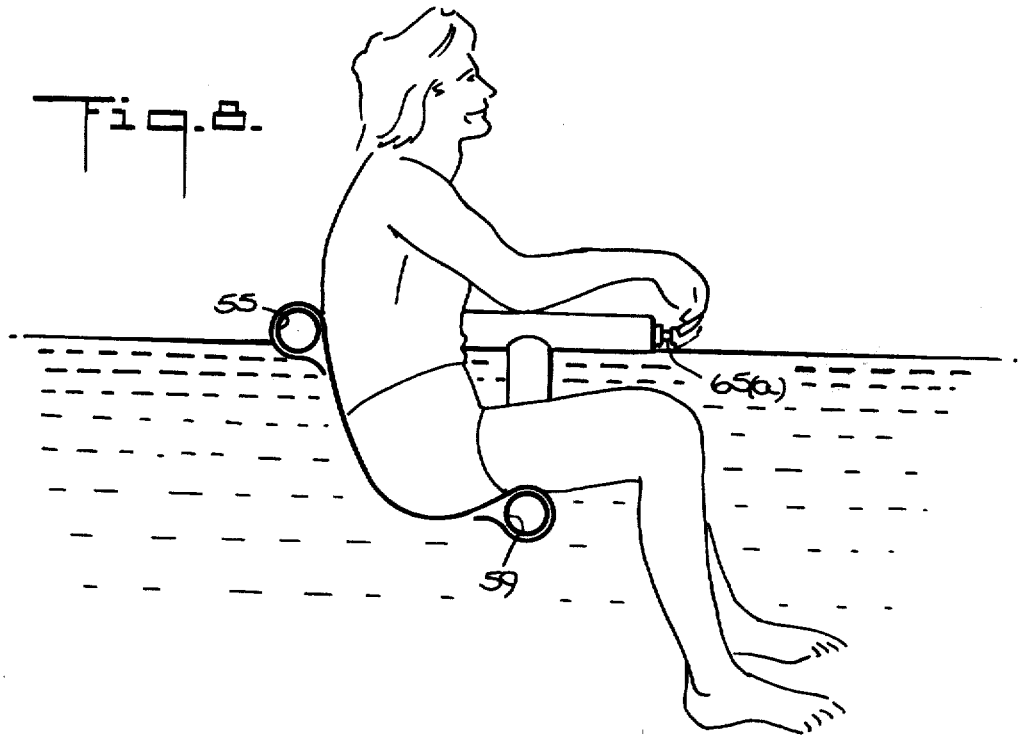

SUBMERSIBLE FLOATATION STRUCTURE

BACKGROUND OF THE INVENTION

1. Field of the Invention

This invention relates to a submersible floatation structure, having adjustable buoyancy which is useful as buoyant pool and swim related equipment and in the construction of such equipment. A more limited aspect of this invention relates to the use of such a structure in the construction of buoyant devices such as buoyant chairs, rafts, life preservers and the like which are of light-weight construction, and which can be used by swimmers as a means to either float upon the surface of water in a comfortable upright, seated, reclining or lounging position, or to support a person in a partially or completely submerged position. Still another limited aspect of this invention relates to the use of such a submersible floatation structure in the construction of durable and light weight floats, buoys, shipboard life saving equipment, and submersible underwater play equipment.

2. Description of the Prior Art

Various forms of buoyant devices, such as chairs, rafts, floats, buoys and the like have been proposed for use in water. These devices have been used to support a person in the water, or for other purposes which require a floatation capacity. In each instance, such devices usually employed various types of buoyant sections which provide the floatation capacity. These buoyant sections are usually constructed of lighter-than-water materials such as styrofoam, cork, balsa wood and the like, and air-inflatable flexible materials, such as rubber structures.

While such devices are in wide use, they have several inherent disadvantages which are chiefly associated with the characteristics of the buoyant sections. For example, those devices employing air inflatable pontoons as the buoyant sections are unreliable from the safety standpoint, because the pontoons are easily punctured and are subject to tears and abrasions from rough surfaces. Further, these air-inflatable pontoons are difficult to repair, especially when torn along a seam.

Those devices employing air inflatable pontoons as the buoyant section also are not suitable for use on land, and indeed are often required to be tied down; because their light weight renders them easily blown about by the wind. Further, when such air-inflatable pontoons are used as the buoyant sections of buoyant chairs, such chairs lack sufficient strength to support a person on land. Accordingly, these chairs can only be used in the water and cannot be used as stationary furniture on decks, docks, beaches or at pool-side.

Conventional buoyant devices having air-inflatable pontoons are also difficult to store unless the air is removed. However, air removal and replacement is difficult and time consuming.

Conventional buoyant devices having lighter-than-water pontoons as the buoyant sections obviate at least one of the disadvantages of the devices having air-inflatable pontoons, that is, the tendency to puncture. But these devices also suffer from a number of inherent disadvantages. For example, conventional devices often used pontoons constructed of styrofoam as the buoyant section, which is subject to chipping and peeling. This leaves an undesirable residue in pools, skimmers, filters and drains, which often clogs pool filters, and can result in unnecessary pool maintenance expenses. Further, these devices are not durable and are of very light weight, and thus are subject to being blown away by the wind when used on land. Therefore, these devices are designed for limited use in water only, and cannot be kept on land or on ship board unless tied down or maintained in an indoor environment. When lighter-than-water pontoons are used as the buoyant section of buoyant chair-like devices, these devices cannot be used on ship board or land as stationary furniture because of the non-durable construction and because of their light weight.

In conventional buoyant devices having pontoons made of cork, foam, kapok, fiber glass, or balsa wood, the pontoons must be covered with fabric, coated cloth or plastic. These pontoons are expensive, and the pontoon coverings are susceptible to mildew, fungus and other forms of deterioration.

Another disadvantage of conventional buoyant devices results from their frame construction. For example, most conventional buoyant chairlike devices, rafts and the like have rigid frames which are constructed of aluminum, stainless steel, and the like, which connect air-inflatable or lighter-than-water pontoons and body supporting sections together to form an integral unit. In such conventional buoyant devices, the quantity of metal framing is kept to a minimum, because the metal reduces the overall buoyancy of the device. However, such minimized quantities of metal also reduce the overall strength and durability of the devices making them practically useless as stationary furniture for use on land or aboard ships. However, even the small quantity of metal framing contained in such conventional devices is subject to rust and corrosion when subjected to water, which shortens the useful life of the device, and which also requires increased maintainance efforts.

The increasing numbers of swimming pools and individuals participating in swimming activities have resulted in an unfilled demand for submersible floatation swimming equipment that can be efficiently used both on and under the surface of water. Commercially available water sports equipment presently falls into the distinct classes of either surface or underwater equipment. Surface swimmers have available to them many types of such equipment for activities which include water polo, basketball and the like. However, while there are many types of functional equipment for underwater swimmers, such as goggles, flippers, general scuba gear and the like, there are no submersible game devices specifically designed for underwater swimmers.

It is therefore an object of this invention to provide a submersible floatation structure which obviates the aforementioned disadvantages of conventional buoyant devices.

It is also an object of this invention to provide a submersible floatation structure which can be used in the construction of selectably submersible and buoyant devices that can be used on the surface of the water, under the water and on beaches, decks, docks, at pool-side, and the like, as stationary furniture.

It is another object of this invention to provide a submersible floatation structure which can be used in the construction of buoyant devices such as life preservers, buoys, floats, buoyant chairs, rafts and the like which are capable of withstanding rough handling, abnormal stresses and strains, and which are resistant to rust, corrosion, mildew, fungus and other forms of deterioration.

It is yet another object of this invention, to provide a submersible floatation structure which can be used in the construction of water play equipment for use both, on and under the surface of the water, and which has means for adjusting the buoyancy of such equipment so that they can be partially submerged, sunk to the bottom, or suspended somewhere there between.

It is an object of this invention to provide a buoyant chair-like device of light-weight, one-piece, rigid structure which is capable of withstanding rough handling, abnormal stresses and strains, and which resists rust, corrosion and other deterioration.

It is also an object of this invention to provide a buoyant chair-like device having adjustable buoyancy such that the device can float on the surface of the water with a person therein, or such that the person can be supported in a partially or completely submerged position.

It is still another object of this invention to provide a buoyant chair-like device which is particularly strong and durable, and which is highly resistant to leaks resulting from punctures, tears, and abrasions.

It is yet another object of this invention to provide a buoyant chair-like device which requires a minimum of protection from the elements when not in use; which is easy to clean; and which is economical to manufacture.

It is a further object of this invention to provide a buoyant chair-like device which can be used in water, and which can also be used as stationary furniture for use on a dock, deck, beach or at poolside.

Other and further objects of this invention will be apparent to those skilled in the art from the following specification, claims and drawings.

SUMMARY OF THE INVENTION AND ITS USES

The foregoing and other objects are achieved by the present invention which provides a submersible floatation structure which is useful in the construction of swim and boat related equipment. The basic structure element of this invention is a combination rigid frame and buoyant section means which defines a rigid structure and which also defines one or more air-tight chambers. The rigid structure functions as the basic supporting framework for the structure of this invention, and the air-tight chambers function as the buoyant sections.

In the preferred embodiments of this invention, combination rigid frame and buoyant section means is merely one or more hollow elongated elements of circular, square, rectangular, hexagonal or like cross-section which are fitted together through the use of various fittings, as for example, elbow joints, T-shaped joints and like coupling fittings, into the desired structural configuration. Illustrative of such hollow elongated members are pipes, tubes and elongated prismatic structures.

Hollow elongated members of a wide variety of sizes and wall thicknesses can be used, which allow a large degree of flexibility in the types, shapes, size and designs of swim and boat related equipment that can be constructed using the submersible floatation structure of this invention. For example, large diameter, heavy walled sewer pipes float well, and can be used in the construction of a raft or pontoons large enough to support one or more persons and can be used in the construction of underwater play equipment. Smaller diameter, thin wall pipes can be used in the construction of floats, buoys, bib life preservers and buoyant chairs which can also be used as stationary furniture on decks, docks, beaches and the like and whose buoyancy or weight can be adjusted such that they are not blown away by gusts of wind.

The combination rigid frame and buoyant section means is a rigid structure, and is constructed of a lightweight, strong and durable synthetic polymeric material, as for example polyvinyl chloride, polycarbonate, polyurethane, polyethylene and the like. Such materials are water resistant and durable. These materials do not rust or corrode and are resistant to other forms of deterioration as, for example, fungus and mildew. Also, if punctured or if leaks occur such materials can be rapidly and easily repaired merely by using well-known commercially available cements and sealing compositions for such materials.

Polyvinyl chloride is preferred for use in the construction of the submersible floatation structure of this invention. Polyvinyl chloride is light in weight and inexpensive, which, in addition to its durability, reliability and availability, render it an excellent material to use in the construction of the submersible floatation structure of this invention. The use of pipes and fittings composed of polyvinyl chloride also provides for ease of assembly and shipping. For example, the use of such a material allows hollow pipes and fittings to be packaged as small units for shipping purposes, which can be easily self-assembled by the buyer. There are several polyvinyl chloride pipe cements available that can be conveniently used for bonding these pipe sections and fittings together in a desired structural configuration.

Associated with the combination frame and buoyant section means is buoyancy adjusting means for adjusting the buoyancy of the structure. Buoyancy adjusting means is adapted to allow the inflow of water into one or more of the air-tight chambers, while at the same time allowing the outflow of a corresponding volume of air. The result is a decrease in the buoyancy of the structure, or an increase in its weight. The buoyancy adjusting means is also adapted to allow the outflow of a selectable amount of water from one or more of the air-tight chambers while at the same time allowing the inflow of a corresponding amount of air. This results in an increase in the buoyancy of the structure or a decrease in its weight. In the preferred embodiments of this invention, the buoyancy adjusting means is comprised of one or more water inflow/outflow passages which allow the inflow and the outflow of water to and from the airtight chambers. In the preferred embodiments of this invention, the buoyancy adjusting means also comprises one or more air inflow/outflow passages which allow the corresponding inflow of air into and the outflow of air from the air-tight chambers. Thus, in the operation of the submersible floatation structure of this invention, the buoyancy or overall weight of swim or boat related equipment constructed from the inventive structure can be increased or decreased at will. For example, buoyancy can be decreased merely by introducing water into the chambers, through the water inflow/outflow passage means, while at the same time ejecting air from the chambers through the air inlet/-outlet passage means. This procedure is continued until the desired buoyancy or weight is achieved. In this manner, a sufficient quantity of water can be introduced into the air tight chambers such that the buoyancy of the equipment can be decreased to the extent that it is partially submerged, completely submerged, sunk to the bottom or assumes any desired floating position.

As is known to those of skill in the art, a decrease in buoyancy corresponds to an increase in weight. Therefore, when water is introduced into the air tight chambers the weight of the structure is increased such that it can be used as stationary equipment on land or aboard ship, without being overturned or blown away by high winds.

The buoyancy of equipment constructed from the submersible floatation structure of this invention can be increased and the overall weight can be decreased by introducing air into the air tight chambers by way of the air inlet/outlet passage means, while at the same time ejecting water from the chambers by way of water inlet/outlet passage means. Thus, all water can be ejected from the chambers and the structure can float on the surface of the water, or the water can be removed to provide for more convenient transporting and storage of the structure.

In the preferred embodiments of this invention, water inlet/outlet passage means, and air inlet/outlet passage means are each merely one or more inlet and outlet passages through the wall of the chambers, which provide fluid communication between the interior of the chamber and the exterior of the structure of this invention. In the preferred embodiments of the invention, there is associated with these passages means for controlling the inflow and outflow of either air or water from the chambers as desired. The structure of such control means will depend on the type of swim and boat related equipment involved. For example, in some types of equipment constructed from the submersible floatation structure of this invention, such as bib or cushion type floats, this function can be conveniently performed merely by removing a removable section of the combination frame and buoyant section means and water or air can be either introduced or removed from the chamber by way of the opening so produced.

In other types of swimming and boat related equipment constructed in accordance with this invention, this function can be performed by rubber or plastic stoppers or screw caps, at least one of which is associated with the outlets of each of the one or more passages. Examples of such drain plugs are found in bait wells, boat drains and the like. Thus, either of these sealing elements can be used to prevent either the outflow or inflow of water or air. In this embodiment, the passages can be conveniently opened merely by removing the stopper or by unscrewing the caps, and can be closed by reinserting the stopper or re-screwing the screw cap into sealing engagement with the outlet of the passage. In this embodiment, it is convenient to attach each stopper or screw cap to the framework by way of attaching means, such as a long and flexible piece of plastic or a chain, so that the stopper or the cap remains attached to the framework even when not in sealing engagement with the outlets of the one or more passages.

In still other types of swim and boat related equipment constructed from the submersible floatation equipment of this invention, such as buoyant chairs, rafts, boat-like structures or the like, valve means as for example, needle valves, ball valves, stopcocks and the like can be used. The valve means is positioned in the aforementioned passages such that they directly or indirectly regulate the outflow and inflow of either air or water into and from the air tight chambers. Such valves are well-known to those of skill in the art, and will not be described herein in detail.

The submersible floatation structure of this invention can be conveniently used to construct various types of swim and boat related equipment and thus, this invention is intended to have wide application relative to such equipment. For example, the structure can be used to construct a bib type life preserver. Small capped sections of polyvinyl chloride pipe can be fitted together in rib fashion. In this embodiment, the capped sections of pipe at the top and behind the neck section should be larger than the other pipe sections in order to keep the head at the proper level. The preserver also includes v-shaped front and back pipe sections which tie under the crotch to support the seat and back of the occupant. Lastly, the preserver includes a collar attachment constructed of polyvinyl chloride tubing that will keep an unconscious person's head out of the water in moderate seas. It should be appreciated that the structure is hollow which provides for full buoyancy throughout.

Also, the structure of this invention can be used in the construction of ring buoy types and other types of floats; buoyant cushions; and rafts and boat-like devices. The structure can also be used in the construction of chairs which have adjustable buoyancy which enables their use as buoyant chairs in the water and as stationary furniture for use on boat decks, docks, at poolsides or on beaches. When used in the construction of such rafts, boat-like devices and chairs, the structure of this invention will also include person supporting means, for supporting one or more persons on the chairs, rafts or boat-like structures. In the preferred embodiments of this invention, person supporting means is merely a flexible piece of plastic or cloth webbing which is stretched between sections of the hollow pipe-like combination frame and buoyant section means. Any such webbing used for body support within the buoyant frame must be attached without puncturing the combination frame and buoyant section means. This can be accomplished in several ways. For example, sleeves for attachment of the webbing can be installed at the time of assembly; or plastic straps or webbing can be attached with clips or snaps. Also, the webbing can even be laced to the combination frame and buoyant section means with ropes.

The submersible floatation structure of this invention can be used in the construction of devices designed for use in underwater games. For example, through use of the adjustable buoyancy capability, large float-like structures constructed of large polyvinyl chloride pipes can be submerged and used as underwater caverns for pool or beach play. Similarly, a number of large ring-type floats can be coupled together and suspended vertically under water, and can be used as tunnels, or as obstacled courses for underwater swimmers.

The submersible floatation structure of this invention can also be used in the construction of dual purpose devices having utility in and out of the water. For example, ring type structures can be constructed in varying sizes, and can be placed in stacked relation to provide various types of boat furniture, such as a coffee table, end table, bar or the like. In emergency situations, the furniture can be readily disassembled to function as life-saving equipment.

As can be appreciated from the foregoing, this invention is generic in nature, and the structure of this invention is intended for widespread use where durable, light weight, and deterioration resistant structures, having adjustable buoyancy capabilities are required or useful.

BRIEF DESCRIPTION OF THE DRAWINGS

A more complete appreciation of the invention and the attendant advantages thereof will be more readily apparent as the same becomes understood by reference to the following detailed description when considered in conjunction with the accompanying drawings wherein:

FIG. 7 is a perspective view of another buoyant chair embodiment of this invention ready to support an occupant on the surface of the water;

FIG. 8 is a utility view of the embodiment of FIG. 7, illustrating the use of that embodiment as a buoyant chair in water.

DETAILED DESCRIPTION OF THE PREFERRED EMBODIMENTS

Figure 1:
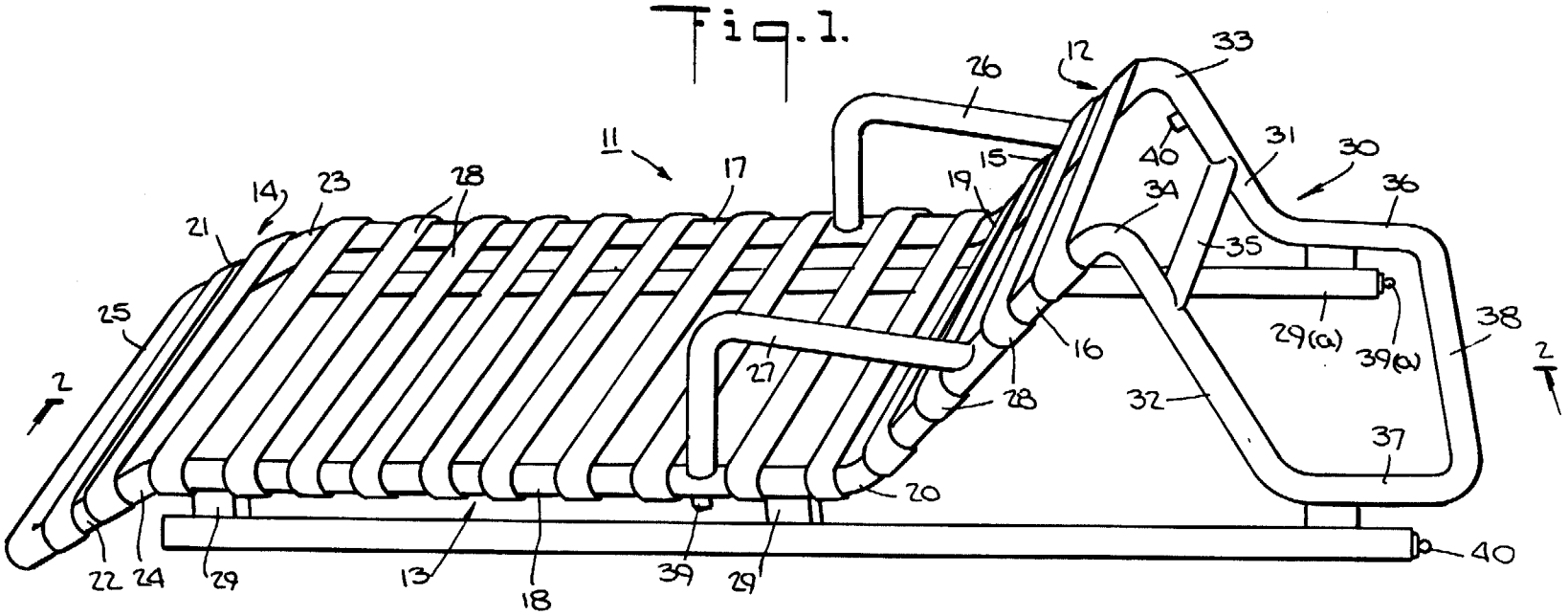
FIG. 1 is a perspective view of a buoyant chair embodiment of this invention in one operative position ready to support an occupant on land.

Referring now more particularly to FIGS. 1 to 5 of the drawings, there is depicted an illustrative example of one embodiment of a light weight buoyant chair 11 of this invention having adjustable buoyancy means such that the chair can float on the surface of the water with a person therein, or the buoyancy can be decreased such that a person can be supported in a partially or completely submerged position as desired. The buoyancy adjusting capability can also be used to increase the weight of the chair such that the chair can be conveniently used as stationary furniture on a dock, deck, beach or the like and will not be easily blown about by strong gusts of wind as would normally be the case because of its light weight.

The basic framework and the buoyant sections of the buoyant chair 11 comprises a back section designated generally by the numeral 12, a seat section designated by the numeral 13 and a leg support section designated by the numeral 14. The back and seat sections 12 and 13, and leg support section 14, are each preferably formed of joined linear and angular sections of light weight polyvinyl chloride tubing. Thus, when all open ends of the tubing are enclosed as shown in FIGS. 1 and 2, the basic frame forms an elongated air tight chamber which functions as the buoyant section of the buoyant chair 11.

It will, of course, be immediately apparent that the maximum buoyancy of the buoyant chair 11 is dependent on the cross-sectional diameter of the hollow basic support framework and the wall thickness of the polyvinyl chloride tubing. For example, thin rigid wall polyvinyl chloride tubing have a cross-sectional diameter of about 2 to about 4 inches can be used to construct buoyant chairs as depicted in FIGS. 1 to 5, which can support most persons on the surface of the water. Obviously, the chair can be constructed using polyvinyl chloride tubing of greater or lesser wall thickness and cross-sectional diameter to provide the desired buoyancy depending upon the particular requirements.

Figure 2:
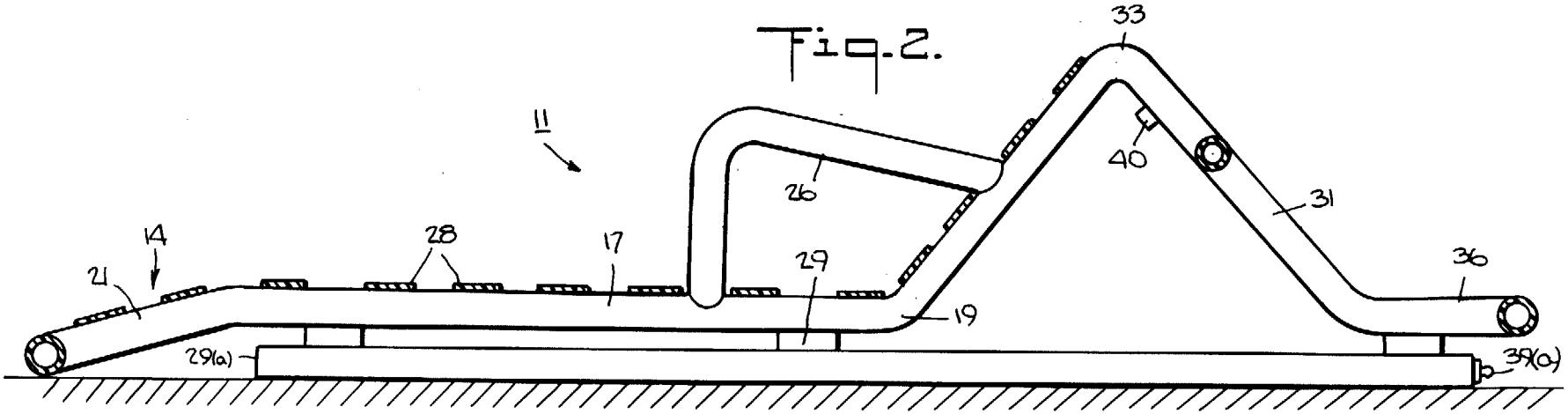
FIG. 2 is a cross-sectional view of the embodiment of FIG. 1 taken essentially along line 2—2'.

As is apparent from FIG. 1, the back section 12 is formed by a pair of parallel hollow elongated sections of polyvinyl chloride, which have been designated back section elements 15 and 16. Seat forming section 13 is also formed by a pair of parallel hollow elongated sections of polyvinyl chloride which have been designated seat section elements 17 and 18. One end of back section element 15 is angularly connected to one end of seat section element 17 by way of angular elbow joint member 19 and one end of the other back section element 16 is connected to one end of the other seat section element 18 by way of angular elbow joint member 20.

Leg support section 14 is formed by a pair of leg support elements 21 and 22 which, in the embodiment of FIGS. 1 to 5, are angularly connected by way of angular joints 23 and 24 to the ends of seat section elements 17 and 18 opposite to the ends of attachment to back section elements 15 and 16. Leg support elements 21 and 22 are connected at the opposite lower ends by transverse connecting foot element 25.

It should be appreciated that the dimensions of the framework; the angular relation and lengths of the back and seat sections 12 and 13, and leg support section 14; and the type and size of tubing used in their construction may be varied according to the desire of the constructor and each such modification falls within the spirit and scope of this invention. For example, in the buoyant chair of FIGS. 1 to 5, the seat section elements 17 and 18, are of greater length than the back section elements 15 and 16. As clearly shown in FIG. 5, this results in a buoyant chair in which the occupant is basically in a reclined position in which only the head and upper shoulders are elevated. On the other hand, if a buoyant chair is desired in which the occupant is in a seated position, the lengths of the back section elements 12 and 16 can be increased such that the entire back, head and shoulders of the occupant are elevated.

The buoyant chair 11, as depicted in FIGS. 1 to 5, also includes a pair of arm rests 26 and 27, which are also constructed of linear sections of hollow polyvinyl chloride tubing. Because of their hollow construction, arm rests 26 and 27 also add to the overall buoyancy of the buoyant chair 11. One end of each of arm rests 26 and 27 is angularly connected to back section elements 15 and 16, respectively, and the opposite end of each or arm rests 26 and 27 is angularly connected to seat section element 17 and 18, respectively. Arm rests 26 and 27 are thus positioned such that they support the arms of the occupant when the occupant is either in a seated or semi-reclining position.

The buoyant chair of this invention also includes person supporting means, which in the embodiment of FIGS. 1 to 5 is a flexible seat comprising a plurality of webbing elements 28 which are fastened to and which extend between the respective pairs of back section elements 15 and 16, seat section elements 17 and 18 and leg support elements 21 and 22. As is readily apparent from FIGS. 1 and 5, webbing elements 28 cooperate with back section 12, seat section 13 and leg support section 14 to maintain the body of the occupant in comfort.

Some embodiments of the buoyant chair of this invention also include chair support means for supporting the chair when it is used on deck, dock, beach or the like as stationary furniture. In the embodiment of FIGS. 1 to 5, such chair support means comprises pontoons 29 and 29(*a*) which are positioned under seat section 14 of the buoyant chair 11. Pontoons 29 and 29(*a*) are constructed of hollow polyvinyl chloride tubing of somewhat larger diameter than that used to construct the other portions of the chair, and accordingly also function as part of the basic framework and buoyant sections means. The chair support means also includes a brace and support section which is generally designated by the numeral 30. Brace and support section 30 consists of a bracing section and a supporting section. The bracing section is formed by a pair of parallel bracing elements 31 and 32, which are angularly connected by way of angular joints 33 and 34 to the upper ends of back section elements 15 and 16 opposite the ends of attachment to seat section elements 17 and 18. As shown in FIGS. 1 and 5, elements 31 and 32, may be optionally reinforced by transverse reinforcing element 35.

The opposite ends of bracing elements 31 and 32 are angularly connected to one end of a pair of parallel support elements 36 and 37, whose opposite ends are connected by a transverse support connecting element 38. Under support elements 36 and 37 are positioned a plurality of elements 39, which cooperate with support blocks 29 to support the chair in an elevated position above the ground.

It should be appreciated that each of bracing elements 31 and 32, reinforcing element 35, support elements 36 and 37 and transverse support connecting element 38 is constructed of hollow polyvinyl chloride tubing. Therefore these structural elements function as part of the basic framework and buoyant sections for the buoyant chair of this invention.

As noted hereinabove, the buoyancy characteristics of the buoyant chair of this invention are provided by the polyvinyl chloride tubing framework. The basic dimensions of this framework can be manipulated within the spirit and scope of this invention to provide sufficient buoyancy to float a person upon the surface of the water. However, a significant advantage of the buoyant chair of the present invention is that it includes buoyancy adjusting means by which the buoyancy of the buoyant chair of this invention can be adjusted so that the occupant can float on the surface of the water or the occupant can be supported in a partially or completely submerged position. The buoyancy adjusting means also allows for an increase in the weight of the chair so that when it is being used as stationary furniture it will not be easily blown about by gusts of winds as would normally be the case because of the light weight of the chair.

In the embodiment of FIGS. 1 to 5, buoyancy adjusting means is water inlet/outlet valve 39 and air inlet/-outlet valve 40 which provide controllable fluid communication between the interior of the hollow framework and the exterior of the chair. As is apparent from FIGS. 1 to 5, valves 39 and 40 consist of openings in each of pontoons 29 and 29(*a*), into which removable plugs such as a conventional through-the-hull boat type drainage plugs 39(*a*) and 40(*a*) have been inserted. Thus, water can be evacuated from or introduced into the hollow polyvinyl chloride tubing merely by removing the plugs.

Figure 3:
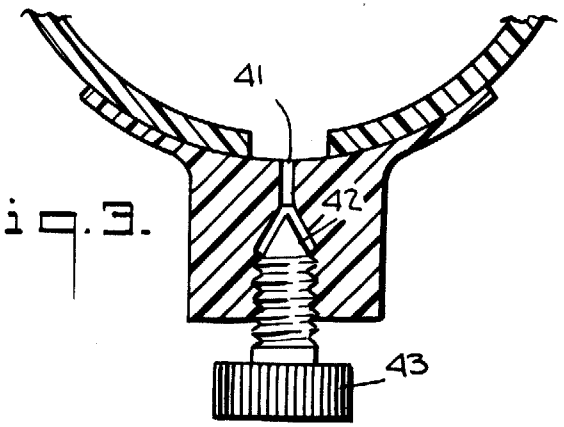
FIG. 3 is an enlarged fragmentary sectional view of a valve and associated passsage which can be used as either water inlet/outlet means or air inlet/outlet means of the embodiments of FIGS. 1 and 7.

An illustrative example of a simple needle type valve which can also be conveniently used as valve 39 or valve 40 is depicted in FIG. 3. In the valve embodiment of FIG. 3, passage 41 extends through the walls of the polyvinyl chloride tubing used to construct the basic structural framework of chair 11. Seated in the outlet passage 41 is needle valve 40. The diameter of the needle portion 42, of needle valve 40 is such that the needle portion 42 is normally in sealing engagement with the outlet of passage 41. Valve 40 is activated manually by way of valve stem 43, which extends from the base of needle valve 41, substantially directly in line with the outlet of passage 41 and away from the framework. When the valve stem 43 is rotated it unseats the needle portion 42 from its sealing engagement with the outlet, thereby opening it and allowing the outflow or inflow of water and gases from and into the chamber to the desired extent. To close the valve, valve stem 43 need only be rotated in the opposite direction, which returns needle portion 42 to its normal position in sealing engagement with the outlet of passage 41.

Figure 4:
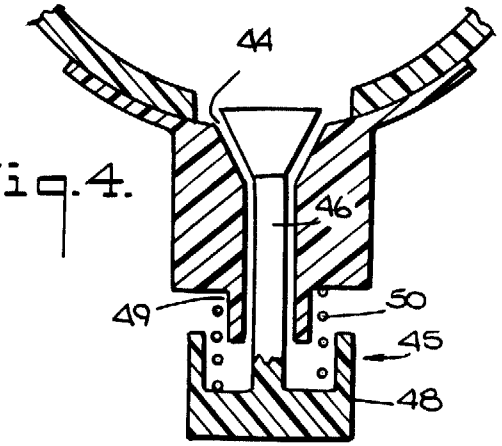
FIG. 4 is an enlarged fragmentary sectional view of another valve and associated passage which can be used as either air inlet/outlet means or water inlet/outlet means of the embodiments of FIGS. 1 and 7.
Figure 5:
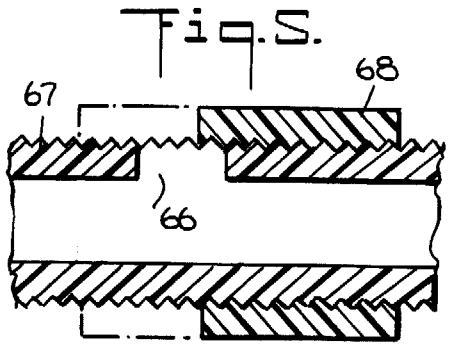
FIG. 5 is an enlarged fragmentary sectional view of another valve and associated passage which can be used as either air inlet/outlet means or water inlet/outlet means of the embodiments of FIGS. 1 and 7.

An illustrative example of a simple plunger type valve which can be used as valve 39 or valve 40 is depicted in FIG. 4. In the embodiment of FIG. 4, passage 44 extends through the polyvinyl chloride tubing used to construct the basic structural framework of the chair 11. Positioned in the passage 44 is a valve member 45. Valve member 45 consists of a rod 46 which is positioned in passage 44. The diameter of rod 46 is such that fluids, either water or air, can flow between the surfaces of passage 44 and the surface of rod 46. Attached to one end of rod 46, in the interior of the hollow polyvinyl chloride tubing is interior closure member 47, and attached to the other end of rod 46, on the exterior of the tubing is valve activation member 48. Valve member 44 is slidably mounted to the framework of chair 11, by way of housing guides 49. Coil spring 50 having a diameter between that of rod 46 and valve activation member 48 is positioned about the perimeter of rod 46. Attached to one end of rod 46, in the interior of the hollow polyvinyl chloride tubing is interior closure member 47, and attached to the other end of rod 46, on the exterior of the tubing is valve activation member 48. Valve member 44 is slidably mounted to the framework of chair 11, by way of housing guides 49. Coil spring 50 has a diameter which is intermediate of of the diameters of rod 46 and the interior of valve activation member 48, and is positioned about the perimeter of rod 46. In the operation of this embodiment, interior closure member 47 is maintained in sealing engagement with the passage by the resilient force of coil spring 50. To open the passage to adjust the buoyancy, valve activation member 48 is depressed toward the exterior surface of the polyvinyl chloride tubing which overcomes the resilient force of coil spring 50, thereby unseating interior closure member 47 and opening the passage 44. Thus, air or water can be allowed to flow into or out of the hollow polyvinyl chloride tubing framework, to adjust the buoyancy. When the desired buoyancy is achieved, valve activation member 48 is released and interior closure member 47 is returned to its normal position of sealing engagement with the passage 44 by force of the resilient coil spring 50.

An illustrative example of a simple screw type valve which can be conveniently used as valve 39 or valve 40 is depicted in FIG. 5. In the valve embodiment of FIG.

5, passage 66 extends through the walls of the polyvinyl chloride tubing 67 used to construct the basic structural framework of chair 11. About the circumference of tubing 67, screw valve sealing element 68 is positioned. As is apparent from FIG. 5, the exterior surface of tubing 67, on both sides of the outlet of passage 66, and the interior surface of valve element 68 are threaded, such that these surfaces are in threaded engagement. The length of element 68 is greater than the diameter of the outlet of passage 66 so that the element 68 can seal the outlet as indicated in FIG. 5 by the dashed lines. The valve embodiment of FIG. 5 is activated merely by rotating element 68 in one direction about the longitudinal axis of tubing 67 to the position depicted in FIG. 5 by the solid lines. When in this position, the valve element 68 is not in sealing engagement with the outlet of passage 66 so that water and gases can now flow into or out of hollow polyvinyl chloride framework. To close the valve, valve element 68 need only be rotated in the opposite direction which moves it to the position depicted by the dashed lines in which it is in sealing engagement with the outlet of passage 66.

Figure 6:
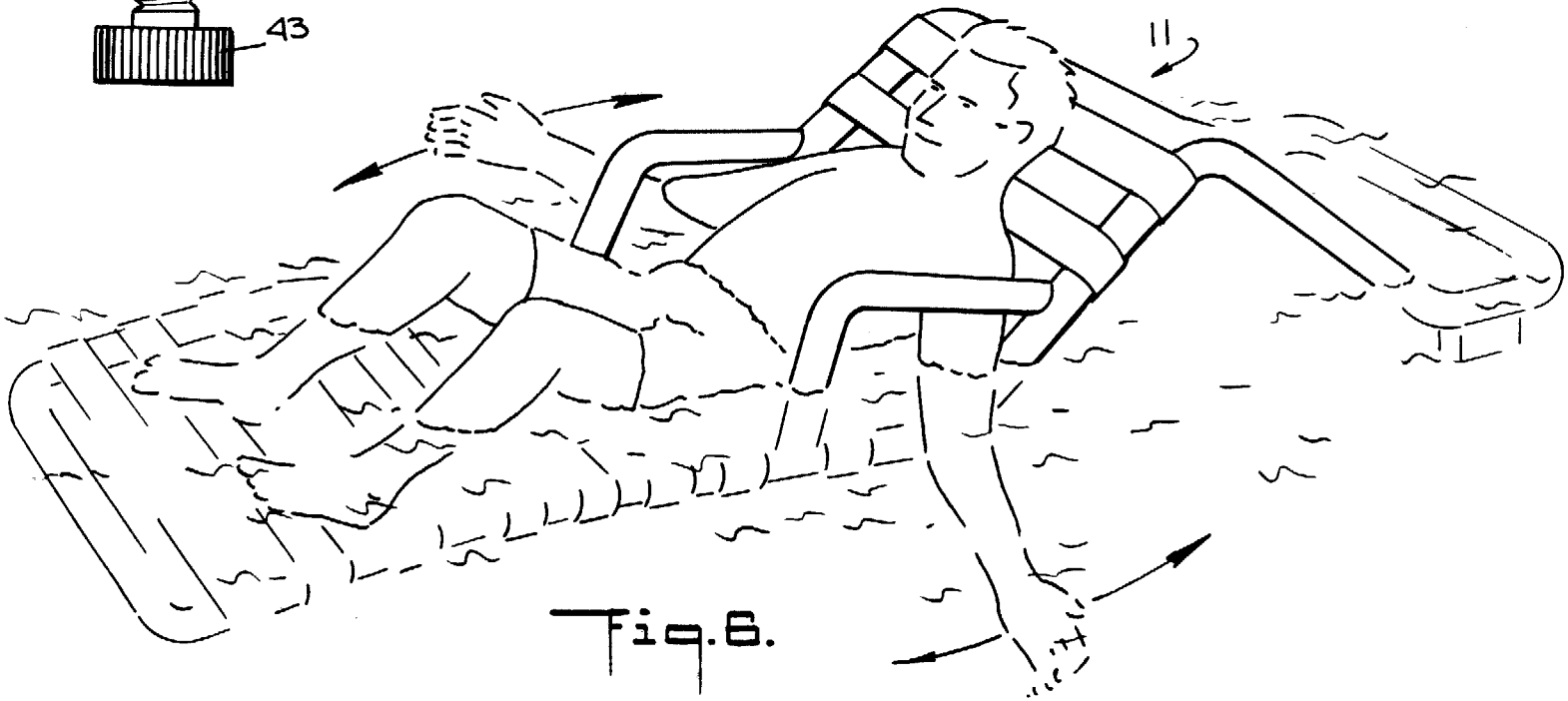
FIG. 6 is a utility view of the embodiment of FIG. 1, illustrating the use of that embodiment as a buoyant chair in water.

With all of the various elements and parts associated together as described above it will be appreciated that the combination of elements provides a chair in which the occupant can float on the surface of the water, or in which the occupant can be supported in a partially or completely submerged position. FIG. 6 illustrates the general positions which the structural elements of the chair will assume relative to the water when the chair is in an operative position on the water. Due to the angular relationship of the section of the basic framework it will be appreciated that the occupant of the chair may restfully sit therein in a semi-reclining position as the chair floats on the water and moving his arms and hands the occupant may propel himself along the water. When in this semi-reclining position the occupant's seat is supported by seat section 13 with his legs being supported by leg support section 14 and with his back resting on back section 13 and his arms resting on arm rests 26 and 27. Further through use of water inlet/outlet valve 39, and air inlet/outlet valve 40, the buoyancy of the embodiment of FIGS. 1 to 5 can be adjusted such that the occupant can either float on the surface of the water, or be in a partially or completely submerged position to escape the heat of the sun, and for greater comfort.

An alternative chair-like embodiment of this invention is depicted in FIGS. 7 and 8. Referring to these drawings in detail, the embodiment depicted therein comprises a combination back and arm rest section 51 for supporting the back and arms of an occupant, and a seat support section 52 which aids in supporting the seat of the occupant. Each of sections 51 and 52 is constructed of hollow polyvinyl chloride tubing joined in air tight connection, thus forming a plurality of elongated air-tight chambers. Sections 51 and 52 form the basic structural framework of the chair-like embodiment of FIGS. 7 and 8 as well as its buoyant sections.

Combination back and arm rest section 51 is comprised of a pair of elongated arm rest elements 53 and 54, joined at each end in air-tight connection by a back element 55 forming a u-shaped structure. The seat support section 52 is a u-shaped structure which is aligned substantially transverse to the plane of combination back and arm rest section 51. Section 52 comprises a pair of tubular side elements 57 and 58 which are joined to back and arm rest elements 53 and 54, respectively, orthogonally thereto at about the mid-point of their longitudinal axes. Elements 57 and 58 extend downwardly transverse to the longitudinal axis of elements 53 and 54, and extending between their lower ends is a tubular seat element 59.

Element 59, in cooperation with the natural buoyancy of the occupant's body, is usually sufficient to support the seat of the occupant. However, in the chair-like embodiment of FIGS. 7 and 8, additional seat support is provided by flexible seat structure 60. Seat structure 60 consists of a plastic or fabric hammock seat, which, at its upper end, is looped about rearmost connecting element 55 of combination back and arm rest section 51, as at 61. The looped portion is removably fastened to connecting element 55 by means of spaced transverse rows of metal fasteners, metal or plastic eyelets 61 or the like. By providing a plurality of rows of fasteners, the length of the seat may be adjusted. At its lower end, seat 60 is looped over tubular sear element 59 and is fastened thereto by means of suitable fasteners 63. It should be appreciated that the chair-like embodiment of FIGS. 7 and 8 may also be used without the hammock seat 60 as well.

The chair-like embodiment of FIGS. 7 and 8 also includes buoyancy adjusting means for adjusting the buoyancy of the embodiment. The buoyancy adjusting means comprises a combination of water or air outlet-/inlet means 64 and 65, each of which consists of a passage providing controllable fluid communication between the air-tight chambers and the outside of the embodiment by means of a screw cap 65(*a*) positioned at each passage. Water and air outlet/inlet means 64 and 65 are positioned such that they can be readily tipped underwater when a person is seated in the chair-like embodiment. Thus, means 64 and 65 can be used to adjust buoyancy to the desired level while the person is seated in the chair-like embodiment.

It is thus seen from the foregoing that the chair-like embodiment of FIGS. 7 and 8 is so fabricated that it has a one piece, strong, light weight, and rigid framework, which is completely hollow so that it possesses full buoyancy throughout. It is also noted that this buoyancy can be conveniently adjusted by the occupant by introducing water into the hollow spaces formed by the polyvinyl chloride framework while at the same time allowing the escape of an equal volume of air until the embodiment assumes the desired floating position.

To apply the embodiment of FIGS. 7 and 8 to use, it is placed upon the water, and the occupant may assume the position shown in FIG. 8 in which he sits upon tubular seat element 59 and flexible seat structure 60 with his legs dangling from elements 59 and 60, and with his back riding against rear-most connecting element 55 which serves as a back rest. The chair of FIGS. 7 and 8 is so proportioned that the occupant may extend his arm over arm rest elements 53 and 54.

With the occupant thus seated in a somewhat reclining position he may float for as long a period as desired. By moving his arms, hands and feet, the occupant may propel himself along the water. Further, through use of water or air inlet/outlet 64 and 65, the buoyancy of the embodiment can be adjusted such that the occupant can float on the surface of the water with a person therein, or can support the person in a partially or completely submerged position.

Figure 9:
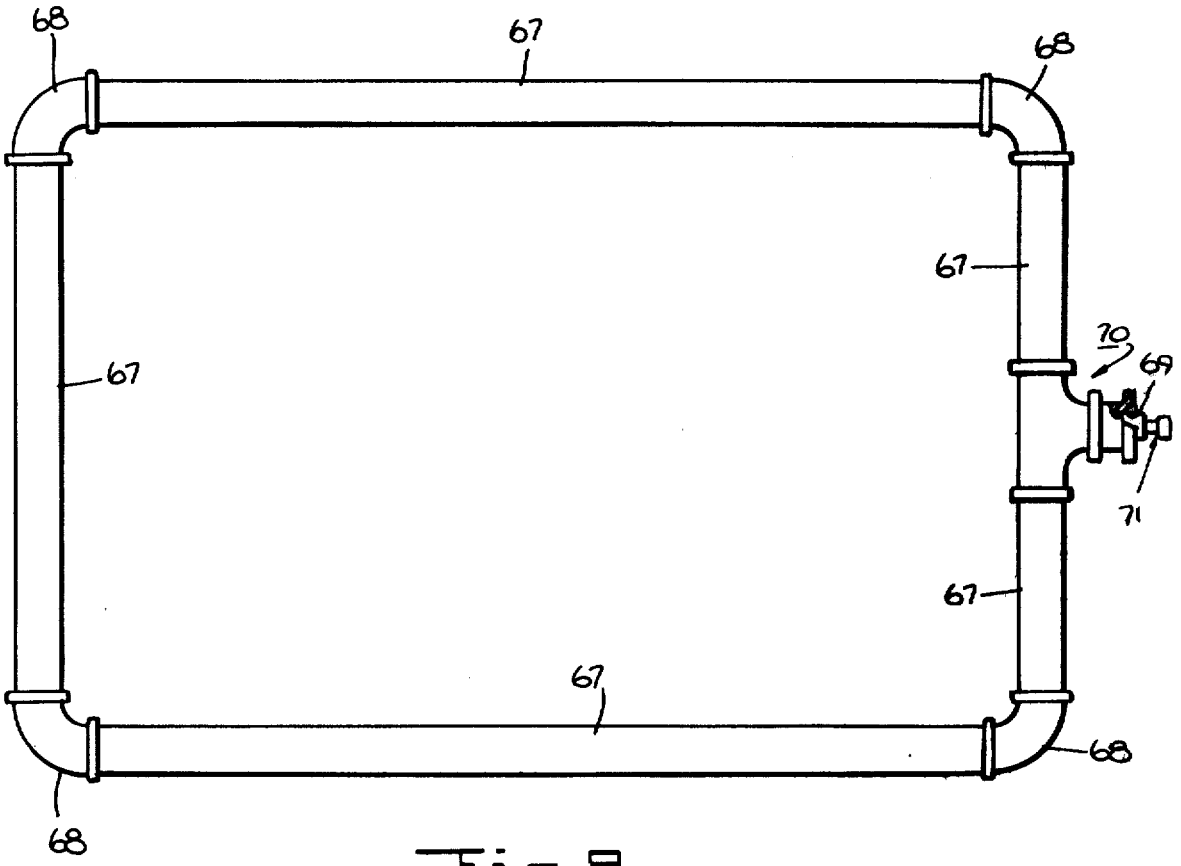
FIG. 9 is a perspective view of a ring float embodiment of this invention.

FIG. 9 depicts a dual purpose ring type floatation structure 66 which can be used in the water for floatation purposes, and which can be used as boat furniture when a plurality of such structures are placed in stack relation. Referring to this drawing in detail, the embodiment depicted is a rectangular structure comprised of a plurality of hollow polyvinyl chloride tubes 67 joined in air-tight connection by elbow connection 68, and valve fitting and passage 69. These elements form one or more air-tight chambers, and function as the basic structural framework and buoyant section means of the embodiment.

The embodiment of FIG. 9 also includes a buoyancy or weight adjusting means generally identified by the numeral 70 which comprises valve fitting and passage 69 and screw cap 71 which is positioned in passage 72 in fluid-tight connection. In this embodiment, the buoyancy or weight of the structure can be readily adjusted by un-screwing cap 71, and either evacuating or introducing water into the air-tight chamber. The cap 71 is then re-screwed, thus maintaining the desired weight or buoyancy.

The embodiment of FIG. 9 is useful both in and out of the water. For example, water can be introduced into the air-tight chamber by way of passage 72 increasing the ballast weight of the structure. A plurality of these structures can be positioned in stack relation to provide furniture for use on board a boat. In case of emergency, the water can be removed as described above, and the structures, either individually or in combination, can function as emergency floatation equipment.

The foregoing description and FIGS. 1 to 9 described the floatation structure of this invention in a preferred form of construction as buoyant chair-like embodiments and examples of ring type floatation structures. It will be understood that various modifications can be made in the structure to construct various other types of buoyant pool and swim related equipment, as for example rafts, life preservers, buoys, floats, underwater play equipment and the like which are within the spirit and scope of the invention as described in the specification, and defined in the appended claims.

What is claimed is:

1. A buoyant chair having adjustable buoyancy such that the chair can selectably float on the surface of the water having a person therein, or support the person in a partially or completely submerged position, the chair comprising:

chair frame means formed of a plurality of hollow elongated polyvinyl chloride members joined in substantially airtight connection by a plurality of hollow angular polyvinyl chloride members to form a hollow structural framework, which can support the person in a seated position when placed on a solid surface said framework including back and seat sections for supporting the back and seat of the person;

buoyancy adjusting means for controllably adjusting the buoyancy of said chair, said buoyancy adjusting means consists of value means to allow the inflow of water into said hollow framework, and the outflow of air therefrom such that the buoyancy of said chair is decreased, and also to allow the inflow of air into said hollow framework, and the outflow of water therefrom such that said buoyancy is increased; and flexible person support means connected to said back and seat sections to support said person in said chair, said person support means being fastened to and extending between selected ones of said members of said chair frame means.

2. A buoyant chair according to claim 1 wherein said chair frame means further includes a leg support section which cooperates with said person support means to support the legs of the person.

3. A buoyant chair according to claim 2 wherein said chair frame means further includes arm rests to support the arms of the person in the chair.

4. A buoyant chair according to claim 3 further including chair support means for supporting said chair frame means of the chair such that the chair can be used as stationary furniture out of the water.

5. A buoyant chair according to claim 4 wherein said back section and said seat section are of generally rectangular configuration, and each of said sections further comprises a pair of rigid elongated hollow members in substantially parallel alignment, the ends of one pair being connected to the ends of the other pair in angular relation, and wherein said person support means is fastened to and extends between said parallel elongated hollow elongated members.

6. A buoyant chair according to claim 5 comprising a generally rectangularly shaped leg support section, said leg support section comprising a pair of elongated hollow leg support members in substantially parallel alignment connected at their ends in either angular or parallel relation to the ends of said seat section opposite to the ends of angular connection to said back section, and said pair of leg support members connected at their opposite ends by a transversely extending hollow elongated connecting leg member; and wherein said person support means is fastened to and extends between said leg support members.

7. A buoyant chair according to claim 6 wherein said chair support means comprises:

a plurality of chair support members positioned under each of said seat and leg support sections; and a brace and support section for bracing and supporting said back support section, said brace and support section comprising a first and second pair of hollow elongated members, the members of each pair being in substantially parallel alignment, one end of said first pair being connected in angular relationship to an end of said second pair, and the opposite end of said first pair being connected in angular relation to the end of said back section opposite the end of attachment to said seat section, the opposite end of said second pair being connected by a transversely extended elongated hollow member, said second pair being positioned in substantially parallel alignment with said seat section, and having two or more support members positioned thereunder.

8. A buoyant chair according to claim 1 comprising:

a combination back and arm rest section for supporting the back and arms of said person in said chair, said combination comprising a pair of rigid elongated hollow members connected at their ends by a pair of rigid elongated connecting hollow members; and a seat support section also comprising a pair of rigid elongated hollow members connected at one end in angular relation to said combination back and arm rest section and extending transversely and downwardly therefrom and connected at the other lower end by a rigid elongated hollow seat connecting member.

9. A buoyant chair according to claim 8 further comprising a flexible seat which cooperates with said combination back and arm rest section and said seat section to support said person, and said seat being connected at one end to said rigit elongated hollow seat connecting member of said seat support section, and connected at the other end to one of said pair of connecting members of said combination back and arm rest section.

10. A submersible floating chair for supporting at least one person in a substantially seated position, said submersible floating chair comprising:

back support means for supporting the back portion of the person occupying the submersible floating chair, said back support means having at least one length of rigid tubing having a predetermined cross-sectional configuration, said tubing being formed of a synthetic polymeric material;

seat support means for supporting the seat portion of the person occupying the submersible floating chair, said seat support means having at least one length of rigid tubing having a predetermined cross-sectional configuration, said tubing being formed of said synthetic polymeric material;

coupling means for coupling said back support means and seat support means to one another to form a rigid submersible floating chair frame having at least one air tight chamber formed within said rigid tubing; and valve means for providing fluid communication with said air tight chamber for controllably adjusting the buoyancy of the submersible floating chair by introducing water therein.

11. The submersible floating chair of claim 10 wherein said back support means and said seat support means each have a plurality of lengths of rigid tubing, said rigid tubing being formed of polyvinyl chloride, said lengths of rigid tubing being interconnected by a plurality of angular coupling sections formed of polyvinyl chloride.

12. The submersible floating chair of claim 10 wherein there is further provided leg support means for supporting the legs of the person occupying the submersible floating chair, said leg supporting means being formed of at least one length of rigid tubing having a predetermined cross-sectional configuration.

13. The submersible floating chair of claim 12 wherein said leg supporting means is coupled to said seat supporting means.

14. The submersible floating chair of claim 10 wherein there are further provided a pair of arm support means for supporting the arms of the person occupying the submersible floating chair, said arm support means being each formed of at least one length of rigid tubing formed of synthetic polymeric material.

15. The submersible floating chair of claim 14 wherein said pair of arm support means are coupled at respective first portions thereof to said back support means, and at respective second portions thereof to said seat support means.

16. The submersible floating chair of claim 10 wherein said valve means comprises a first fluid flow passage for providing liquid communication with said air tight chamber.

17. The submersible floating chair of claim 16 wherein said valve means comprises a second fluid flow passage for providing gaseous communication with said air tight chamber.

18. The submersible floating chair of claim 17 wherein said first and second passages are provided with respective fluid flow regulation means for controlling the rate at which fluid communicates through said first and second fluid flow passages.

19. The submersible floating chair of claim 10 wherein there are further provided a pair of pontoon means for providing further buoyancy and structural strength to the submersible floating chair, said pontoon means each being mechanically coupled to respective portions of said seat and back support means of the submersible floating chair.

20. The submersible floating chair of claim 19 wherein said pontoon means are formed of respective lengths of tubing formed of said synthetic polymeric material to form at least one air tight pontoon chamber, and are further provided with buoyancy control means for providing fluid communication with said air tight pontoon chamber.

21. The submersible floating chair of claim 10 wherein there is further provided flexible occupant support means for comfortably supporting the person occupying the submersible floating chair, said flexible occupant support means being connected to said back and seat support means, respectively.

* * * * *